United States Patent [19]

Polan et al.

[11] Patent Number: 4,739,835

[45] Date of Patent: Apr. 26, 1988

[54] QUICK RESPONSE GLASS BULB SPRINKLER

[75] Inventors: George S. Polan, North Wales, Pa.; Hermann R. Glinecke, Morrisville, N.J.

[73] Assignee: Central Sprinkler Corp., Lansdale, Pa.

[21] Appl. No.: 877,053

[22] Filed: Jun. 23, 1986

[51] Int. Cl.[4] ..... A62C 37/14

[52] U.S. Cl. ..... 169/38; 116/216; 206/822

[58] Field of Search ..... 169/37, 38, 40, 41, 169/42; 206/528, 822; 116/216, 217; 374/159; 137/70

[56] References Cited

U.S. PATENT DOCUMENTS

| | | | |
|---|---|---|---|
| Re. 16,132 | 8/1925 | Loepsinger | 169/38 |
| 1,733,701 | 10/1929 | Taylor | 169/38 |
| 4,609,047 | 9/1986 | Pieczykolan | 169/38 |
| 4,619,327 | 10/1986 | Pieczykolan | 169/38 |
| 4,648,459 | 3/1987 | Pieczykolan | 169/38 |
| 4,657,085 | 4/1987 | Jacobsen | 169/38 X |

FOREIGN PATENT DOCUMENTS

| | | | |
|---|---|---|---|
| 3601203 | 3/1987 | Fed. Rep. of Germany | 169/37 |
| 731200 | 6/1955 | United Kingdom | 169/41 |
| 1350991 | 4/1974 | United Kingdom | 169/41 |
| 1349935 | 4/1974 | United Kingdom | 169/37 |

*Primary Examiner*—Joseph F. Peters, Jr.
*Assistant Examiner*—James M. Kannofsky
*Attorney, Agent, or Firm*—Seidel, Gonda, Goldhammer & Abbott

[57] ABSTRACT

A sprinkler head having a body portion with a fluid outlet port closed by a valve member retained in the closed position by a bulb of frangible material having three or more planar sides of uniform thickness and containing a heat-expansible fluid, the end of the bulb remote from the valve being supported by a deflector plate formed as part of a vertically adjustable three strut yoke depending from said body portion.

19 Claims, 2 Drawing Sheets

FIG. 4
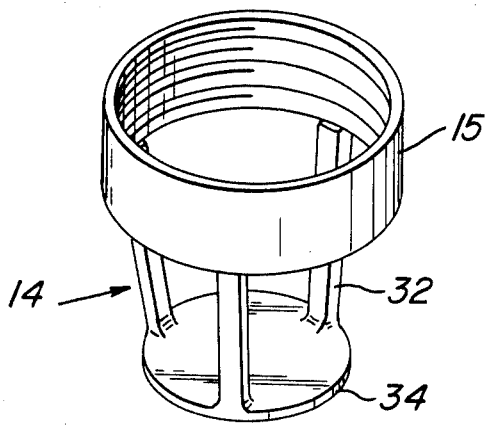
FIG. 5
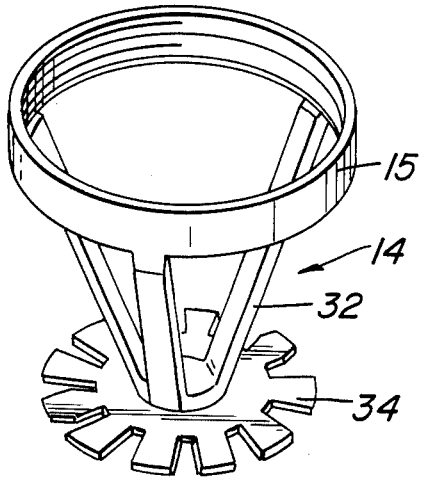
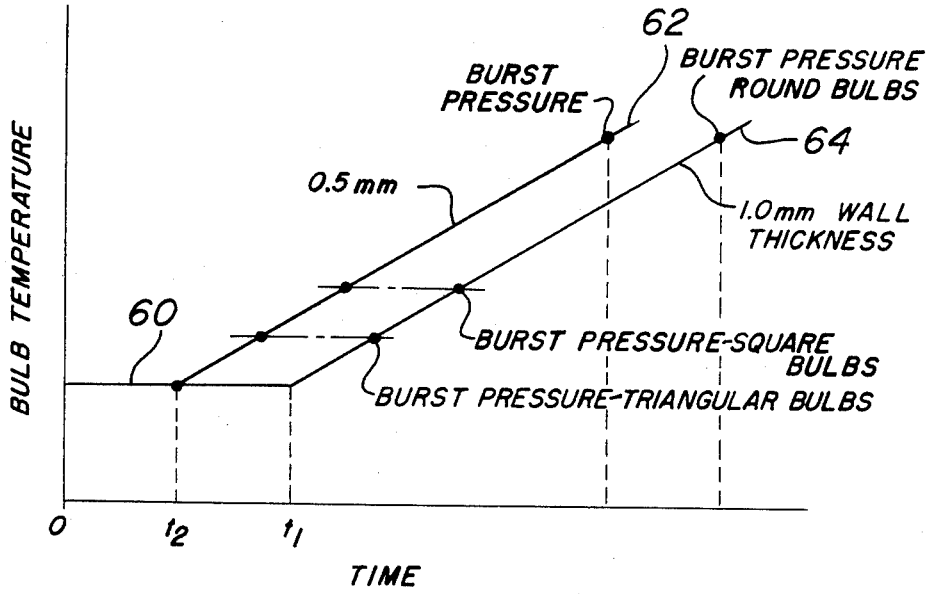
FIG. 6

QUICK RESPONSE GLASS BULB SPRINKLER

BACKGROUND OF THE INVENTION

It is known to provide a sprinkler head having a valve member retained in a closed position by a latch means. It is known to provide a temperature responsive means for releasing such a latch means. It is desirable to use a bulb of glass or other frangible material and containing a temperature responsive fluid as the temperature responsive means. In order for such a bulb to be sensitive, it has heretofore been thought necessary that the bulb have very thin walls. Since the bulb is used as a latch retainer, the fluid system pressure imposes a practical limit on how small and thin-walled the bulb can be. The present invention provides a solution to this seeming impasse.

In copending application U.S. Pat. No. 4,619,327, there is disclosed a solution of the problem of how to reduce compressive pre-load on the bulb whereby the bulb may be smaller and thinner than prior art bulbs. Copending application U.S. Pat. No. 4,609,047 discloses three-sided, non-uniform-thickness bulbs designed to achieve improved sensitivity. The present invention is directed to a solution of the problem of how to produce a small, thin-walled bulb having a configuration which will cause the bulb to rupture more quickly than prior art bulbs while retaining the ability of the bulb to resist compressive forces.

SUMMARY OF THE INVENTION

The present invention is directed to a sprinkler head for discharging a fire-quenching fluid when the surrounding environment is subjected to a pre-determined temperature. The sprinkler head includes a body having a flow passage. A valve member is provided for controlling flow through said passage. A latch means is provided for retaining the valve member in a closed position. A temperature responsive means is used as the latch means. The temperature responsive means includes a bulb of frangible material and containing a heat expansible fluid. The bulb is designed to rupture more quickly than prior art bulbs without reduction in compressive strength.

It is an object of the present invention to provide a glass bulb sprinkler head having improved reaction time through use of a novel bulb structure.

It is a further object of this invention to provide novel bulb and bulb support configurations which reduce frame arm shadow and frame arm spray voids and which in combination provide sprinkler heads having improved reaction time.

Other objects and advantages will appear hereinafter.

For the purpose of illustrating the invention, there is shown in the drawings a sprinkler head arrangement which is presently preferred; it being understood, however, that this invention is not limited to the precise arrangements and instrumentalities shown.

FIG. 4 is a perspective view of one form of sprinkler head head yoke embodying features of the present invention.

FIG. 5 is a perspective view of an alternative form of sprinkler head yoke, and FIG. 6 is a temperature-time graph depicting reaction time dependence on bulb thickness.

DETAILED DESCRIPTION

Figure 1:
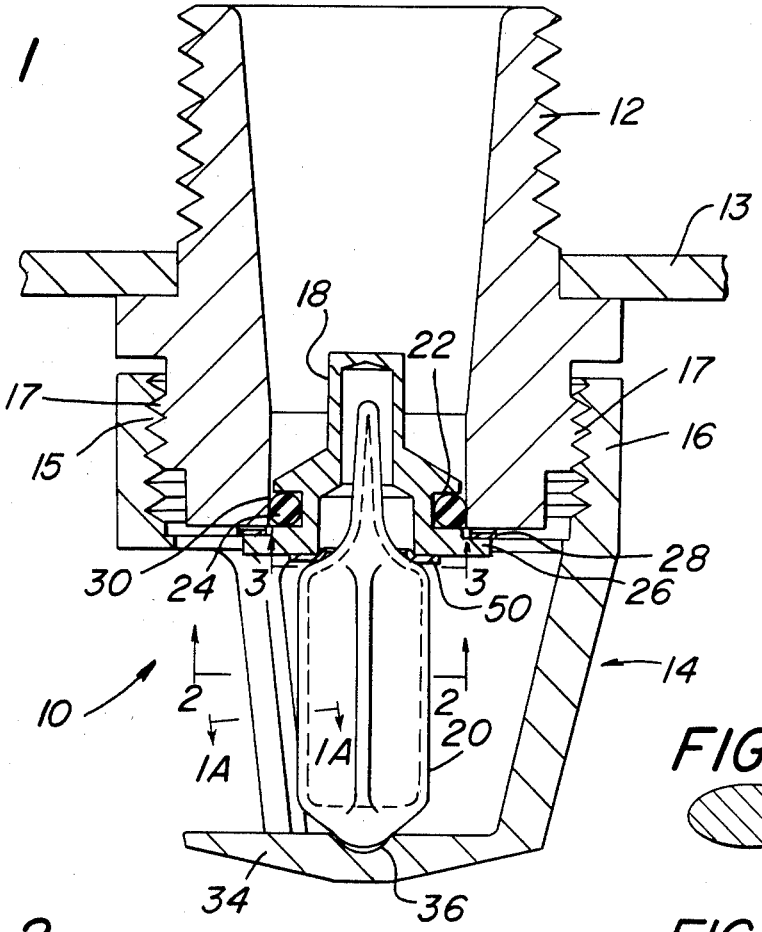
FIG. 1 is a sectional view of a sprinkler head embodying the present invention and showing the sprinkler head in a closed position.
Figure 1A:
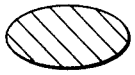
FIG. 1A is a sectional view taken along the line 1A—1A of FIG. 1.

Referring to the drawings in detail, wherein like numerals indicate like elements, there is shown in FIG. 1 a sprinkler head in accordance with the present invention designated generally as 10 and connected to one end of a sprinkler body 12 disposed behind a wall or ceiling 13. The sprinkler head includes a yoke 14 having internal threads 15 provided on a cylindrical portion or annulus 16 formed at one end of the yoke. Threads 15 are meshed with threads 17 formed on the outer surface of the sprinkler body 12. Saddle 18, in the form of a truncated cone supported on the frangible bulb 20, comprises the valve element. The saddle is provided with a peripheral groove 22 containing a resilient O-ring 24 which bears compressively against the walls of the sprinkler body 12 to form the seal. The lower end of the saddle is provided with a radially outwardly extending flange 26. A wave spring 28 is located between flange 26 and a bottom annular surface of body 12. The spring 28 urges the valve into the open position. To assist release of the O-ring upon fracture of the bulb 20, the neck portion 30 of the body 12 is tapered. In order that the wave spring not run out of travel, its free height is chosen as two times the distance between the center line of the O-ring and the shoulder against which the wave spring is seated.

Sprinkler head constructions such as shown in U.S. application U.S. Pat. No. 4,619,327 permit reduction in preload requirements and consequent use of thinner walled bulbs. We have discovered that by changing the cross-sectional configuration or geometry of the bulb that dramatic reductions in reaction time can be achieved. By using bulbs having planar sides, such as bulbs having square or triangular cross-sectional configurations, as contrasted with bulbs having a circular configuration, while keeping the overall cross-sectional area of glass unchanged, it is possible to maintain the compressive strength of the bulb while both reducing its internal volume and burst pressure.

A listing of the various critical parameters of round, square and triangular tubing constructed to have the same cross-sectional area of glass is shown in the following tabulations:

| | | | | |
|---|---|---|---|---|
| ROUND TUBING | | | | |
| O.D. cm | .4 | .4 | .4 | .4 |
| I.D. cm | .3 | .3 | .3 | .3 |
| Wall Thickness cm | .05 | .05 | .05 | .05 |
| Area Glass $cm^2$ | .054978 | .054978 | .054978 | .054978 |
| Burst Pressure $kg/cm^2$ | 216.667 | 216.667 | 216.667 | 216.667 |
| SQUARE TUBING | | | | |
| Inside Radius cm | 0 | .05 | .1 | .15 |
| Wall cm | .05 | .05 | .05 | .05 |
| Outside Radius cm | .05 | .1 | .15 | .2 |
| Radii Distance cm | .235619 | .157080 | .078540 | 1.81E-9 |
| Inside cm | .235619 | .257080 | .278540 | .300000 |
| Outside cm | .335619 | .357080 | .378540 | .400000 |
| Area Glass $cm^2$ | .054978 | .054978 | .054978 | .054978 |
| Burst Pressure $kg/cm^2$ | 48.2930 | 86.6020 | 161.728 | 216.667 |
| TRIANGULAR TUBING | | | | |
| Inside Radius cm | 0 | .05 | .1 | .15 |
| Wall Thickness cm | .05 | .05 | .05 | .05 |

-continued

| | | | | |
|---|---|---|---|---|
| Outside Radius cm | .05 | .1 | .15 | .2 |
| Radii Distance cm | .314159 | .209440 | .104720 | 2.41E-9 |
| Height cm | .272070 | .183880 | .100690 | .022500 |
| Area Glass $cm^2$ | .054978 | .054978 | .054978 | .054978 |
| Burst Pressure $kg/cm^2$ | 28.9405 | 56.0984 | 127.447 | 216.667 |
| COMPARISON: BURST PRESSURE | | | | |
| Round % | 100.00 | 100.00 | 100.00 | 100.00 |
| Square % | 22.29 | 39.97 | 74.64 | 100.00 |
| Triangular % | 13.36 | 25.89 | 58.82 | 100.00 |
| COMPARISON: VOLUMES | | | | |
| Round % | 100.00 | 100.00 | 100.00 | 100.00 |
| Square % | 78.54 | 90.46 | 97.62 | 100.00 |
| Triangular % | 60.46 | 82.43 | 95.61 | 100.00 |

As will be observed from the above, the burst pressure of triangular tubing having a cross-sectional area of glass of approximately 0.055 square centimeters is 28.94 $kg/cm^2$ compared to 48.29 $kg/cm^2$ for square tubing having the same cross-sectional area of glass and 216.67 $kg/cm^2$ for conventional round tubing having an identical cross-sectional area of glass.

It will also be observed that in the case of the square and triangular tubing, namely tubing which employs planar sides, the sharpness of the inside corner radius plays an important role in determining the burst pressure which the tubing can withstand. The larger the inside radius of curvature, the more resistant the tubing is to being fractured by internal pressure. Accordingly, it will be seen that the ideal configuration for a bulb, which exhibits optimum sensitivity to internal pressure while at the same time being capable of withstanding compressive loads, is to use a triangular bulb having planar walls of uniform thickness and sharp internal edges. The theoretical basis underlying this discovery is that the failure mechanism in utilizing planar sides is one of combined tension and bending as contrasted with a failure mechanism when using round tubing which is based solely on the tensile strength of the material.

When the fluid contained within the bulb expands, it pushes out uniformly in all directions against the inside surface of the bulb. Each of the planar sides acts as a beam whose failure mode is dependent on the the modulus of elasticity of the material, the moment of inertia of its cross section, the effective length of the side and the internal pressure to which it is subjected. This mode of failure is quite distinct from that of a bulb of round cross section as borne out by the empirical data given above.

Another factor which influences reaction time is the yoke structure of the sprinkler head. Conventional yokes employ two arms, or struts. By employing a three-strut yoke 14, as shown in FIGS. 4 and 5, each strut 32 may be made thinner and streamlined so as to reduce frame-shadow effect. Thus, the flow of heated air to the bulb is increased without sacrificing strength. The yoke is in the form of a cage having three thinned struts, the cross section of each strut being configured to facilitate air flow. In the embodiments shown in FIGS. 4 and 5, the struts converge towards a circular deflector plate 34, the central portion of which acts as a support for the glass bulb in the manner shown in FIG. 1. The yoke construction shown in FIG. 4 is the one used in the sprinkler head illustrated in FIG. 1.

Figure 2:
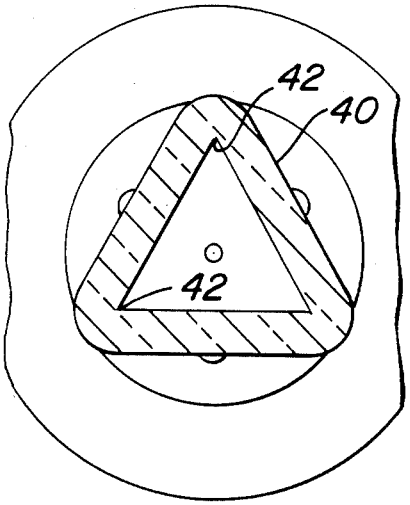
FIG. 2 is a sectional view taken along the line 2—2 of FIG. 1.
Figure 3:
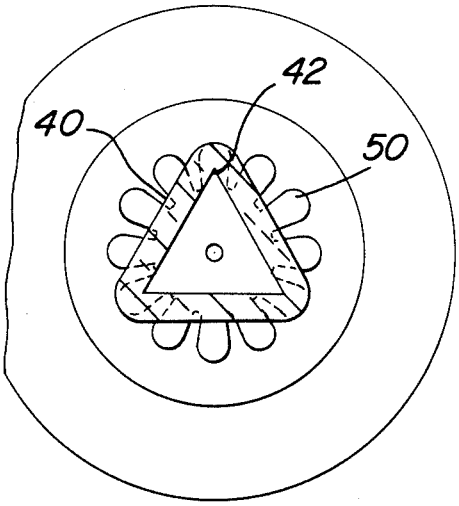
FIG. 3 is a sectional view taken along the line 3—3 of FIG. 1.

The yoke, or cage 14, is constructed as an integral piece and is adapted to be adjustably attached to the body portion 12 defining the sprinkler head cylindrical outlet port. The annulus 15 of the yoke is internally threaded to mate with an externally threaded portion formed on the outer wall of body portion 12. This construction allows for adjustment of the preload pressure to be placed on the bulb 20 to effect proper closure of the valve seal. A depression 36 is formed on the inner surface of deflector 34 to support one end of bulb 20. A preferred shape of bulb for achieving minimal reaction time is the triangular configuration shown in cross section in FIGS. 2 and 3. The bulb is constructed to have flat planar sides 40 of uniform thickness and sharp internal corners 42. As previously noted, the outlet port with which the sprinkler head is associated is closed by valve element, or saddle, 18. The saddle is supported on the frangible bulb 20. To accommodate the asymmetric or non-spherical shape of upper portions of the bulb, the bulb is cradled in a stress-compensating washer 50 interposed between the bulb upper surfaces and saddle 18. This washer is circular and has a serrated central aperture 52. This type of washer will tend to deform to accommodate the geometry of the bulb end. The construction of the washer can best be seen in FIG. 3. By using the cage structure, the yoke arms or struts, tend to occlude water flow much less than conventional forms of structure resulting in less frame arm spray voids, i.e., area which is not reached by the water being expelled by the sprinkler head. This novel form of yoke construction, as previously noted, also provides for improved air flow to the bulb, thus reducing reaction time in the event of fire.

Bulbs constructed in accordance with this invention should have at least one planar side. The preferred embodiment is to use the triangular configuration shown in FIGS. 1, 2 and 3, although bulbs of other cross-sectional configuration, such as a square or other multi-sided figure may be used. As previously noted, the objective to be achieved is to provide a bulb whose failure mode, due to internal pressure, results from the combination of bending and tensile stresses. This can be achieved by utilizing any number of bulb configurations in addition to the preferred forms illustrated herein.

Sprinkler head designs such as shown in application U.S. Pat. No. 4,619,327 referenced above make possible the use of a maximum preload of only 10 pounds on the bulb. A standard orifice opening, such as would be employed in the present invention, is 0.15 square inches. Accordingly, every 10 psi hydrostatic pressure results in a load of 1.5 pounds on the bulb. Standard testing of a sprinkler is conducted at 500 psi and 700 psi. 500 psi is the minimum hydrostatic pressure for checking seal integrity. 700 psi is the highest hydrostatic pressure used to check seal integrity. 500 psi results in 75 pounds additional load on the bulb, hence the total load on the bulb is 75 pounds plus 10 pounds preload, or a total load of 85 pounds. Using 700 psi results in an 105 pound loading on the bulb. Hence, under maximum hydrostatic pressure the bulb is subjected to a total load of 115 pounds. A glass bulb having 5.5 square millimeters of wall section area is capable of withstanding a compressive load of approximately 470 pounds. Accordingly, under the conditions just postulated, a glass bulb of triangular configuration having a wall thickness of 0.5 millimeters, and a length on each side of 4.1 millimeters can operate under maximum load conditions with a safety factor of over 4 to 1, thus permiting use of bulbs of even thinner cross-sectional area having still lower burst pressure characteristics.

Referring to FIG. 6 of the drawings, it will be seen that the reaction time of the sprinkler head is dependent, among other things, on the thickness of the bulb wall.

The ordinate of the graph is the temperature of the bulb alcohol and the abscissa is time. The horizontal flat portion 60 of the graph indicates that in the event of fire, there is initially no change in alcohol temperature for a time which is directly dependent on that required for the heat to penetrate the thickness of the bulb wall. Once the heat reaches the interior of the bulb, the alcohol temperature rises linearly until a temperature is reached at which the burst pressure is sufficient to rupture the bulb. The slope of lines 62 and 64 is determined by the heat characteristics of the liquid itself. For a given bulb configuration with a given burst pressure, the response time is directly proportional to bulb-wall thickness. The two lines 62 and 64 represent bulbs having a wall thickness of 0.5 mm and 1.0 mm respectively.

It will thus be seen that the combination of features provided by this invention results in a sprinkler head having an improved response time without sacrifice of seal integrity.

The present invention may be embodied in other specific forms without departing from the spirit or esential attributes thereof and, accordingly, reference should be made to the appended claims, rather than to the foregoing specification, as indicating the scope of the invention.

We claim:

1. A sprinkler head for discharging a fire quenching fluid, comprising a body having a flow passage therethrough, a bulb of frangible material containing a heat expansible fluid and, said bulb having a top, a bottom and at least one planar side wall of uniform thickness, a valve element closing said flow passage and held in sealing engagement therewith by said bulb, spring means interposed between the said valve element and said body and held by said valve element in compressive engagement with body portions continguous said flow passage thereby to urge said valve element into open position, and resilient means disposed in sealing engagement between peripheral surfaces of said valve element and adjacent surfaces of said body.

2. A sprinkler head in accordance with claim 1 wherein said planar side wall of uniform thickness extends from one corner area of said bulb to an adjacent corner area of said bulb, said corner areas having relatively sharp internal corners.

3. A sprinkler head in accordance with claim 1 wherein said bulb of frangible material has three planar walls of uniform thickness and each wall lies in a different plane.

4. A sprinkler head in accordance with claim 3 wherein said bulb of frangible material is longer than it is wide and has three or more planar walls of uniform thickness, each wall lying in a different plane and each wall extending substantially the entire length of said bulb.

5. A sprinkler head in accordance with claim 1 including a stress compensating washer interposed between said bulb and said valve element.

6. A sprinkler head in accordance with claim 5 wherein said stress compensating washer has a centrally disposed edge-serrated aperture.

7. A sprinkler head comprising a body having an outlet port, a valve element closing said port, a frangible bulb of triangular-cross-sectional configuration having a top, a bottom and planar side walls of uniform thickness and containing a heat expansible fluid, a yoke vertically adjustably mounted to said body and comprising an annulus, a deflector plate and three or more struts interconnecting said annulus and deflector plate, and said bulb being interposed between said valve element and said deflector plate and being held in position by said yoke.

8. A bulb for use as a triggering device, made of frangible material, containing heat expansible material and having a top, a bottom and; at least one planar side wall of uniform thickness extending from one corner area of said bulb to another corner area of said bulb.

9. A bulb in accordance with claim 8 in which said corner areas have relatively sharp internal corners.

10. A sprinkler-head bulb in accordance with claim 9 having a plurality of planar side walls of uniform thickness.

11. A sprinkler-head bulb in accordance with claim 10 having a triangular cross-sectional configuration.

12. A sprinkler-head bulb in accordance with claim 11 wherein said planar walls are connected at corner areas having relatively sharp internal corners.

13. A sprinkler head having a body portion with a fluid outlet port, comprising:

(a) a valve member closing said port, (b) a yoke adjustably mounted on said body portion and comprising three or more struts supporting a deflector in aligned, spaced relation relative to said outlet port, said struts being eqi-spaced about said outlet port, each strut having an elliptical cross-sectional configuration, (c) a frangible element having a top, a bottom and flat sides of uniform thickness and containing a heat expansible fluid interposed between said valve member and deflector and holding said valve member in sealing engagement with said outlet port, and (d) spring means interposed between said valve member and body portion urging said valve into open position.

14. A sprinkler head in accordance with claim 13 wherein said frangible element comprises a triangular shaped bulb having generally planar sides.

15. A sprinkler head in accordance with claim 13 wherein said body portion and yoke are threadably engaged for relative movement therebetween.

16. A sprinkler head comprising a body having an outlet port, a valve element closing said port, a frangible bulb of triangular cross-sectional configuration and having a top, a bottom and planar side walls of uniform thickness and containing a heat expansible fluid, and a yoke, said bulb being interposed between said valve element and said yoke.

17. A sprinkler head bulb made of frangible material and containing a heat expansible fluid and having a top, a bottom, and side wall portions joined at internal corners, such that at least one side wall portion thereof is subject to both bending and tensile stresses sufficient to effect its fracture upon expansion of said fluid.

18. A sprinkler head bulb made of frangible material and containing a heat expansible fluid and having a top, a bottom, and side wall portions each having a uniform thickness, at least one of said side wall portions being joined with other of said side wall portions at internal corners, such that expansion of fluid results in the imposition on said at least one side wall portion of both bending and tensile stresses the additive effect of which is sufficient to fracture said last-mentioned side wall portion.

19. A sprinkler head bulb made of frangible material and containing a heat expansible fluid and side wall portions joined at relatively sharp internal corners such that at least one side wall portion thereof is subject to both bending and tensile stresses upon expansion of said fluid, which bending stresses when added to the tensile stresses result in fracture of said side last mentioned wall portion.

* * * * *